US007293588B2

(12) United States Patent
Dawson et al.

(10) Patent No.: US 7,293,588 B2
(45) Date of Patent: Nov. 13, 2007

(54) WOODWORKING TOOLS

(75) Inventors: Douglas Michael Dawson, Russellville, AR (US); Louis Chalfant, Jr., Russellville, AR (US)

(73) Assignee: Grace Manufacturing Inc., Russellville, AR (US)

( * ) Notice: Subject to any disclaimer, the term of this patent is extended or adjusted under 35 U.S.C. 154(b) by 77 days.

(21) Appl. No.: 11/108,129

(22) Filed: Apr. 18, 2005

(65) Prior Publication Data

US 2006/0231161 A1 Oct. 19, 2006

(51) Int. Cl.
*B27C 1/00* (2006.01)

(52) U.S. Cl. ..... 144/218

(58) Field of Classification Search ..... 144/172–174, 144/218, 117.1, 116, 117.2, 117.3, 117.4, 144/219; 408/204, 239 R, 241 R; 407/29.11
See application file for complete search history.

(56) References Cited

U.S. PATENT DOCUMENTS 542,075 A * 7/1895 Brown ..... 241/240
2,658,258 A * 11/1953 Hawkinson ..... 407/29.11
2,708,376 A * 5/1955 Hodgson ..... 76/24.1
2,982,005 A * 5/1961 Hodgson ..... 29/76.1
2,984,892 A * 5/1961 Oxford et al. ..... 407/29.1
4,074,737 A * 2/1978 Stewart ..... 144/117.1
5,836,528 A * 11/1998 Hilgarth ..... 241/93
6,131,627 A * 10/2000 Zaiser ..... 144/114.1
6,746,187 B2 * 6/2004 Alm ..... 408/241 R

OTHER PUBLICATIONS

Printout from website of Rockler.com regarding the Microplane Rotary Shaper, printed Mar. 10, 2005.

* cited by examiner

*Primary Examiner*—Shelley M. Self
(74) *Attorney, Agent, or Firm*—Dennis B. Haase

(57) ABSTRACT

A rotary shaper tool for use in conjunction with a power tool used to rotate the shaper tool in which a cutter panel is formed about a cylindrical framework. The cutter panel is formed with rows or sets of cutter teeth and an array of vent holes. Chips formed by the engagement of the spinning cutter panel with a wooden workpiece pass to the interior of the shaper tool and are ejected from the vent holes remote from the area of engagement.

19 Claims, 2 Drawing Sheets

WOODWORKING TOOLS

The present invention relates generally to woodworking tools, and, more particularly, to powered tools for the measured removal of material from a workpiece.

BACKGROUND OF THE INVENTION

1. Field of the Invention

Since wood was fashioned by the most rudimentary hand tool, the art has made great strides. In the 21$^{st}$ century, reliance on wood as a primary construction product has diminished, while woodworking as an avocation has substantially increased.

While at one time entire ships and buildings were constructed of wood using the most basic hand tools, those tools, for the most part, are enhanced by the availability of power. Saws, planes, routers, hammers and staplers, sanders, and a multitude of other woodworking tools, are now powered.

With the advent of power tools, even the relatively unskilled are able to achieve higher quality and repeatable results not previously possible. As a consequence, professionals have demonstrably greater skills, and the amateur's interests and satisfaction have been enhanced.

Several such power tools are devoted to creating a finish on woods, while others shape the workpiece. The present invention is in the category of a shaping tool, useable by a power tool, e.g., an electric drill.

2. Overview of the Prior Art

The present rotary shaping tool is a quantum leap from its predecessor, which is the most relevant prior art. The MICROPLANE® rotary shaper drill attachment was an aluminum extrusion which supported multiple cutter sheets. Its use resulted in overheating, which in turn caused clogging and clear deterioration of its cutting ability. It will also be evident that the tooth pattern and configuration is entirely foreign to the present invention.

The device was illustrated on line as item 36747 at an online woodworking superstore catalog, which may be viewed at Rockler.com. The The text proclaims that the unit would not clog, but in truth, it did. Indeed, clogging and overheating became an impediment to the complete success of the MICROPLANE® shaper.

The patent art provides little additional insight into the rotary shaping tools for woodworkers, or, indeed, those who work with other mediums, e.g., cement finishing. In that arena, Fushiya et al. U.S. Pat. No. 4,462,381 bears some passing resemblance to at least one of the objectives of the present invention. In the Fushiya patent, a power cutting tool, for use on a flat cement surface, is disclosed. A flat disk, which is coplaner with the surface of the workpiece, is rotated to remove flecks of cement dust from the surface thereof, and a fan sucks the dust up and away from the surface being finished.

In a similar fashion, Nisho U.S. Pat. No. 5,713,785 employs the same concept work on wood surfaces. Arai et al. U.S. Pat. No. 5,026,221 focuses on the removal of chips created by a milling process.

Noda et al. U.S. Pat. No. 5,451,122 is yet another vacuum type device for a milling machine, and Belanger U.S. Pat. No. 5,031,364 teaches a device for knocking the pintails off screws and rivets.

Finally, Davis U.S. Pat. No. 4,001,792 employs an exhaust hood. The thread common to these patents is the removal of material which has been excised from a workpiece, but, as will become evident, none of them anticipate, or render obvious, the novel approach taught by the present invention.

SUMMARY OF THE INVENTION

The focus, and primary utility, of the present invention rests in the field of woodworking. It comprises a rotary tool, i.e., a tool which is functional as it is rotated about its axis by a powered tool, for the controlled removal of material from a workpiece, which may be a soft or hard wood.

A principal objective of the present invention is to provide woodworkers with a tool of the type described above, which will not clog in extended use. It is another such objective, related to the foregoing, to provide a tool which automatically and continually excises material from a workpiece and expels such material from within the tool as it engages the workpiece, without interfering with the cutting action.

Yet another objective of the present invention is provide a rotary tool of the type described, which will remain sharp for an extended period of use, and, therefore, economical and efficient as a device for the measured removal of material.

It is another, and still further, objective of the present invention to provide a fast and convenient method for the removal and replacement of cutter panels as they eventually become dull.

The foregoing, as well as other objectives and advantages, will become apparent to those skilled in the art from a reading of the forthcoming Detailed Description of a Preferred Embodiment, when taken in conjunction with the accompanying drawings, wherein:

DETAILED DESCRIPTION OF A PREFERRED EMBODIMENT

Figure 1:
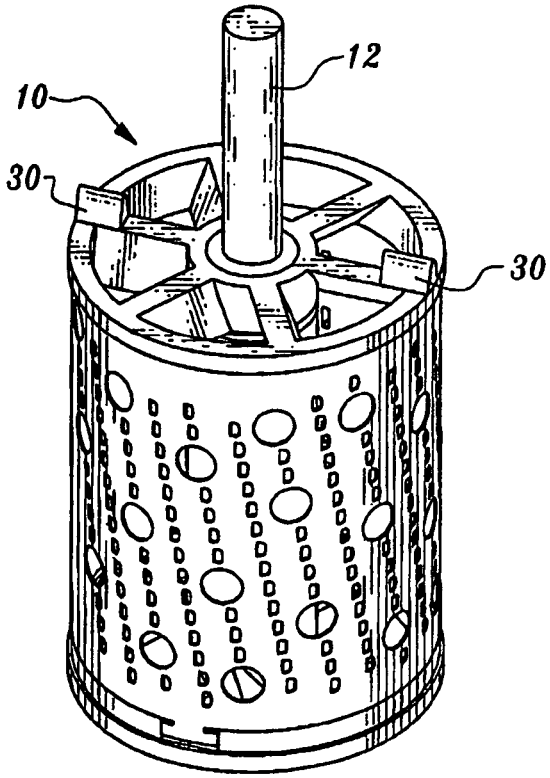
FIG. 1 is a perspective view of a rotary woodworking tool constructed in accordance with the present invention.
Figure 2:
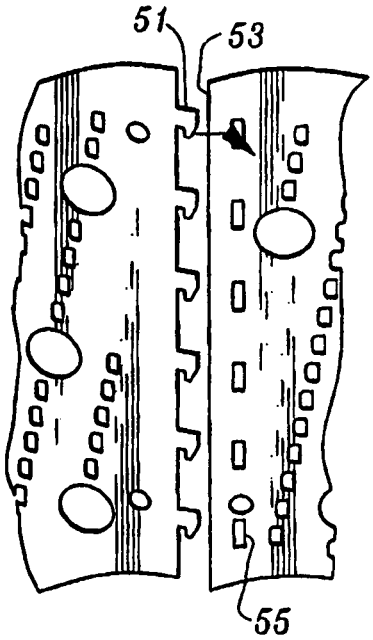
FIG. 2 is a partial sectional view of a cutter panel, illustrating the manner of engagement of the respective ends thereof to form that portion of the woodworking tool of FIG. 1 which engages the workpiece to remove a controlled amount of material therefrom.

With reference now to the drawings, and initially to FIG. 1, a woodworking tool in the nature of a rotary shaper 10 is shown, constructed in accordance with the teachings of the invention.

The rotary shaper 10 is intended to be driven by a power tool such as an electric drill D. It is provided, for that purpose, with a centrally disposed, axial shaft 12, which extends beyond the perimeter of the rotary tool 10.

Figure 3:
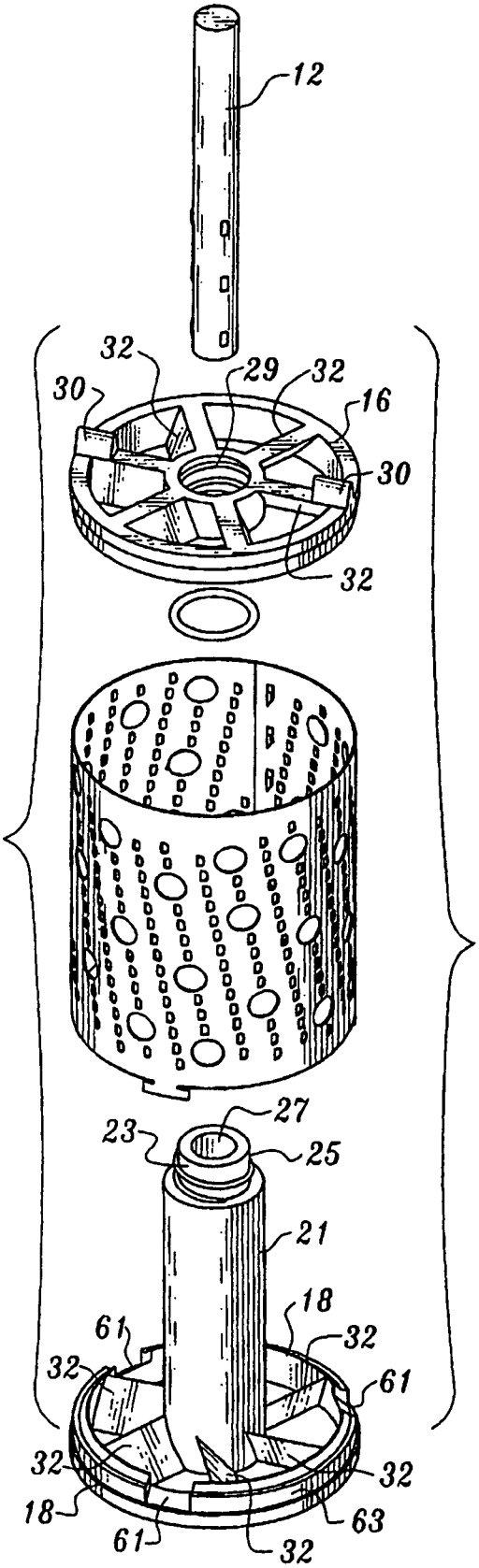
FIG. 3 is an exploded view of the woodworking tool of FIG. 1, illustrating the various elements thereof as they are assembled to define the tool.

The shaft 12 is an integral part of a cylindrical framework, best seen in the exploded view of FIG. 3. The shaper 10 is formed about a cylindrical, skeletal framework which is comprised of a pair of end plates, upper end plate 16 and lower 18, each of which is preferably formed of a moldable material, although it is apparent that a variety of materials might be used. The end plate 18 is formed about an upstanding, axially oriented, center post 21.

The post 21 is formed with a series of threads 23 formed on the reduced end 25 of the post 21, remote from the end plate 18. It is preferred that the threads tighten in a direction opposite the direction of rotation of the drill. Many drills in the present market are reversible, although it is common for a screw or bolt to be rotated in a clockwise direction to be tightened, or otherwise secured, and a left hand thread is used for this example.

As best seen in FIGS. 1 and 3, the axial shaft 12 is pressed, or otherwise secured, in a central bore 27 in the post 21. Experience has demonstrated that it is particularly efficient to affix it during the molding process. Thereafter, the end plate 16, which is formed with a central threaded opening 29, is screwed onto the post 21 to complete the framework for the rotary shaper. It will be noted that a pair of opposed upstanding finger stops, in the nature of tangs 30 are provided to permit the end plate to be secured and, when necessary, removed to replace a cutter panel which has become dulled over extended use. It will be appreciated that while upper and lower end plates are described having various appendages thereto, such designations are for description purposes only, and the orientation may be reversed without departure from the invention.

Since extended application of the rotary shaper 10 to a workpiece W inevitably creates heat, both end plates 16 and 18 are formed, or otherwise affixed, with spokes, which, as shown, are in the nature of fins 32 adjacent openings in said end plate leading to the interior of the rotary tool. The fins are so configured as to draw air through the interior of the tool, causing it to move in a swirling motion. The movement of air through the tool may assist in the prevention of overheating and will have some limited additional salutary benefits, as will appear hereinafter.

The true essence of the tool 10 of the present invention is its unique ability to remove measured and controlled amounts of material, in the form of small chips or slivers, from a wooden workpiece, while simultaneously efficiently disposing of the chips and other wood residue from the immediate area of the contact between the tool and the workpiece. Indeed, the slivers are of such size that to the naked eye, they may appear to be little more than dust. In so doing, the tool is capable of working for extended periods without clogging of the cutting teeth or build up of waste material within the tool, or in the immediate area of removal of material from the workpiece.

Figure 4:
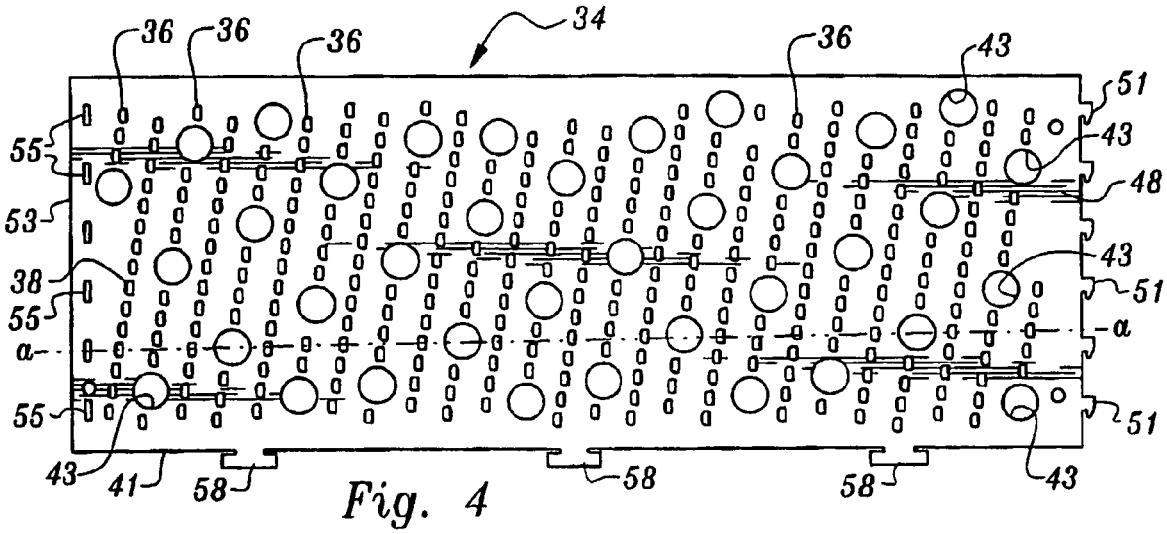
FIG. 4 is a side elevation of the tool of FIG. 1 as it would appear prior to its assembly.
Figure 5:
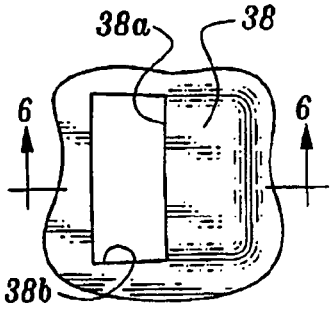
FIG. 5 is a partial sectional view of the panel of FIG. 4, illustrating, as an example, one of the teeth formed in the panel.

In keeping with this objective, a metallic cutter panel 34 is provided and is illustrated in detail in FIG. 4. The panel 34 is formed with a series of sets 36 of cutting teeth, of which twenty six such sets are illustrated. It will be appreciated that the precise number of sets of teeth will depend on the length of the panel, which in turn determines the diameter of the working area of the rotary tool 10.

Still referring to the exemplar illustrated in FIG. 4, each set 36 includes a line of cutting teeth 38, and each set is preferably parallel with every other set. It has been found that if all of the teeth in a row engage the workpiece at the same time, chatter will inevitably be the result. It is important that chatter be prevented, since it will result in handling difficulties and an uneven removal of material.

To insure that chatter is not experienced, the rows of teeth are so aligned as to be other than transverse to the longitudinal axis of the panel. Specifically, as shown, each set is also formed so as to be aligned at an acute angle relative to the lower edge 41 of the panel 34. While perhaps less efficient, it is possible to form the teeth in a random pattern so long as they otherwise satisfy the objectives of the invention by assuring that adjacent teeth do not engage the workpiece substantially simultaneously.

Figure 6:
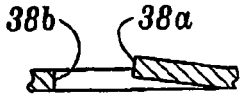
FIG. 6 is a sectional view of the tooth of FIG. 5, taken along lines 6-6 of FIG. 5.
Figure 8:
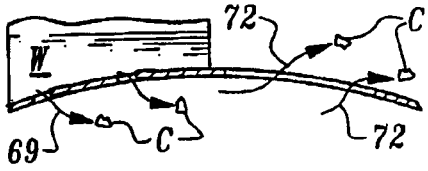
Figure 7:
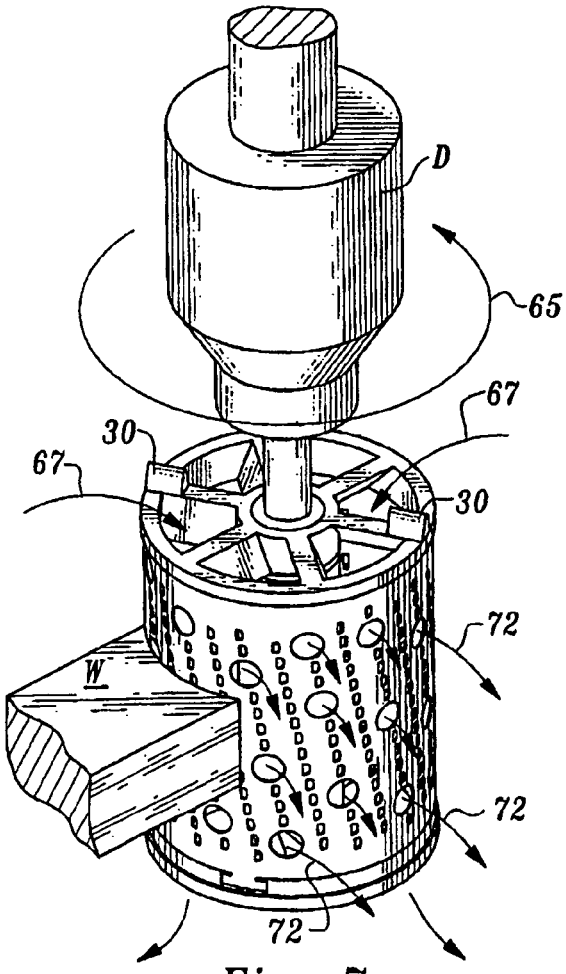
FIG. 7 is a perspective view of the tool of the present invention, illustrating certain details of its operation in conjunction with a workpiece; and, FIG. 8 is an enlarged partial sectional view of the interaction of the tool of the present invention as it acts upon a workpiece.

Each tooth 38, in order to be as sharp as is reasonably possible, is preferably formed by a chemical etching process, such as that taught in Sturtevant et al. U.S. Pat. No. 5,100,506, although teeth formed by other means may be employed without substantial departure from the invention. In any event, each tooth has a sharpened edge 38*a*, which is bent outwardly, as seen in FIG. 6, and the edge 38*a* is located above an opening 38*b*.

The sharpened edge 38*a* removes a measured and controlled amount of material from the workpiece W with each pass, generating a chip, or sliver, of removed material C. The chip C passes through the opening 38*b* into the interior of the tool as defined by the panel and the skeletal frame, defining the tool 10.

Further, in accomplishment of the objective of disposing of material removed from the workpiece W, the panel is formed with several vent holes 43. The vent holes are substantially larger than the opening 38*b* beneath each tooth 38 and are of sufficient shape and area of opening as to permit the passage of any chips C removed from the workpiece by a tooth 38 through such vent holes 43.

In keeping with this objective, the vent holes 43 are formed in rows, and each row is parallel and at an acute angle to the longitudinal axis of the panel. The vent holes are so positioned that there is at least one such hole which is aligned with each tooth 38. For example, by extending a line a-a laterally along the panel and parallel with the lower edge 41 and the longitudinal axis of the panel, there is at least one opening along line a-a aligned with several teeth 38.

The tool is completed, in accordance with the invention, by shaping the panel 34 about the skeletal framework into a cylinder. To this end, the right side 48 of the panel is formed with a series of tabs 51. The left end 53 of the panel 34 is formed with slots 55, which slots are aligned with the tabs 51, such that by wrapping the panel about the framework of the tool 10, the tabs 51 are fitted into and bent back about the slots 55 to thereby hold the panel about the framework of the tool during assembly. In order to assure that the connection is permanent, especially in higher speed use, the respective ends are tacked together by any one of several welding processes.

It is also important to be sure that the panel formed about the framework not rotate relative to the framework, and, to this end, the panel is formed along its edge 41 with tabs 58. In order to receive the tabs, openings 61 are formed in a shelf 63 defined in the lower end plate 18. In operation, the tabs 58 are bent inwardly and are aligned with the openings when the panel is fitted about and conjoined with the end plates 16 and 18. The tabs in the openings prevent rotation of the panel relative to the end plates when the tool is being driven by the drill D.

In operation, the rotary tool is spun by the drill D, for example, in a counterclockwise direction as shown by arrow 65, causing air, indicated by arrows 67, to be drawn into the tool 10. When the tool is pressed against the surface of a workpiece W, a measured amount of material, in the nature of chips C, is removed. The size of each chip C is determined by the depth of the tooth cut and, to a lesser extent, the pressure applied. The chips C pass through the openings 38*b* in the direction of arrows 69 to the interior of the tool as defined by the end plates and the panel formed about the skeletal framework.

The chips C, having a finite, albeit minute, mass, are acted upon by the air currents created by the spinning of the tool and are thrown against the inside wall of the panel 34 by centrifugal force. By virtue of the alignment of the vents 43 relative to the teeth 38, every chip will be moved over one of the vent holes by the forces created by rotation of the tool and will be ejected, or otherwise discharged, from the area in the general direction of one of the arrows 72, remote from the area of contact between the tool and the workpiece.

It will be appreciated that some variation in the structure and assembly of the rotary shaper will occur to those skilled in the art upon reading the foregoing description. However, those variations are deemed to be within the contemplation of the invention, as set forth in the following claims.

The invention claimed is:

1. A rotary shaper tool, for use in concert with a power tool, for removal of measured amounts of material from a workpiece, comprising:

a skeletal framework, said skeletal framework being formed about a central axis;

a flat metallic cutter panel, said metallic cutter panel having at least one tooth formed therein and an opening formed below said tooth;

said metallic cutter panel further having at least one vent hole formed therein, said tooth and said vent hole being of such size as to permit material removed from said workpiece to pass there through; each said vent hole being larger than said opening beneath said tooth;

said metallic cutter panel secured about said skeletal framework to define a cylindrical structure;

said skeletal framework being rotatable by a power tool, such that when said rotary shaper tool is pressed against a workpiece, material in the nature of chips are removed from said workpiece, the chips being moved through said opening to the interior of said rotary tool and thereafter ejected from said rotary tool through said vent hole.

2. The rotary shaper tool of claim 1, wherein said flat metallic cutter panel is formed with several rows of said teeth, each said tooth being positioned relative to at least one of several vent holes as said rotary shaper tool is rotated about its said central axis such that chips removed from the workpiece are ejected from said rotary shaper through a said vent hole.

3. The rotary shaper tool of claim 2, wherein said rows of teeth are at an angle relative to the longitudinal axis of said metallic cutter panel such that each tooth in the same said row engages the workpiece at a time different than an adjacent tooth in said row.

4. The rotary shaper tool of claim 1, wherein said skeletal axis is provided with an upper end plate and a lower end plate, each said end plate having fins formed thereon;

openings formed in said lower end plate adjacent said fins, said openings leading to the interior of said rotary tool and an upstanding, centrally disposed post comprising the central axis thereof.

5. The rotary shaper tool of claim 1, wherein said vent hole is of sufficient size as to permit chips formed by said rotary tool to be ejected from the interior of said rotary tool while being rotated.

6. The rotary shaper tool of claim 4, wherein said metallic cutter panel having remote ends, said ends being engaged about said skeletal framework and fastened to secure said metallic cutter panel thereabout, said fins adapted to draw air through the interior of said rotary shaper.

7. The rotary shaper tool of claim 1, wherein one end of said metallic cutter panel being formed with tabs extending therefrom; another end of said metallic cutter panel being formed with slots, said slots being aligned with said tabs such that when said metallic cutter panel is attached to said skeletal framework, said tabs fit into said slots to secure the ends of said metallic cutter panel thereabout.

8. The rotary shaper of claim 1, wherein said workpiece is wood.

9. The rotary shaper of claim 4, wherein said metallic cutter panel is provided with tabs spaced along a longitudinal edge thereof, slots formed in one of said end plates adjacent said tabs; said tabs being fitted into said slots to prevent rotation of said metallic cutter panel about said skeletal framework during rotation of said rotary tool.

10. The rotary shaper tool of claim 4, wherein one of said end plates being removably fixed to said skeletal framework to permit removal and replacement of said metallic cutter panel as it becomes too dull to be efficient; finger stops formed on said removable end plate to assist in removing said end plate.

11. A rotary shaper tool for use in concert with a power tool to rotate said rotary shaper tool for removal of measured amounts of material from a wooden workpiece, comprising:

a skeletal framework, said skeletal framework being formed with a central axis;

a metallic cutter panel formed about said skeletal framework;

said metallic cutter panel being formed with rows of cutter teeth; an array of vent holes formed in said metallic cutter panel, said vent holes being so positioned that at least a portion of each said vent hole is aligned with several cutter teeth In the direction of rotation of said rotary cutter tool;

each cutter tooth having an opening there below and being aligned with, or at least partially aligned with, one vent hole such that when said shaper tool is rotated about said central axis by a power tool and pressed against a workpiece, a measured amount of material is removed therefrom in the form of chips, said chips passing through said opening below said tooth and moving to a vent hole to be ejected from said shaper tool remote from the area of removal.

12. The rotary tool of claim 11, wherein said teeth are formed and sharpened by a photochemical etching process.

13. The rotary shaper tool of claim 12, wherein said rows of teeth and said vent holes are aligned at an acute angle to the longitudinal axis of said metallic cutter panel.

14. The rotary shaper tool of claim 11, wherein said central axis comprises an upstanding post, said upstanding post being provided with an upper end plate and a lower end plate, each said end plate having fins formed thereon;

openings formed adjacent said fins, said opening leading to the interior of said rotary tool and an upstanding, centrally disposed post comprising the central axis thereof, said fins adapted to draw air through the interior of said rotary shaper.

15. The rotary shaper tool of claim 11, wherein each said vent hole is of sufficient size as to permit chips formed by said rotary tool to be ejected from the interior of said rotary tool through said vent holes while said rotary shaper tool is being rotated.

16. The rotary shaper tool of claim 11, wherein said metallic cutter panel having remote ends, said ends being engaged about said skeletal framework and fastened to secure said panel thereabout.

17. The rotary shaper tool of claim 11, wherein one end of said metallic cutter panel being formed with tabs extending therefrom; another end of said metallic cutter panel being formed with slots, said slots being aligned with said tabs such that when said metallic cutter panel is formed about said skeletal framework, said tabs fit into said slots to secure the ends of said metallic cutter panel thereabout.

18. The rotary shaper tool of claim 17, wherein said metallic cutter panel is provided with tabs spaced along the lower longitudinal edge thereof, slots formed in said lower end plate, said tabs being fitted into said slots to prevent rotation of said metallic cutter panel about said skeletal framework during rotation of said rotary tool.

19. The rotary shaper tool of claim 14, wherein one of said end plates is removably fixed to said skeletal framework to permit removal and replacement of said metallic cutter panel as it becomes too dull to be efficient; finger stops formed on said removable end plate to assist in removing said end plate.

* * * * *